US007836956B2

(12) United States Patent
Smithson et al.

(10) Patent No.: US 7,836,956 B2
(45) Date of Patent: Nov. 23, 2010

(54) POSITIONAL CONTROL OF DOWNHOLE ACTUATORS

(75) Inventors: Mitchell C. Smithson, Pasadena, TX (US); Timothy R. Tips, Spring, TX (US); Corrado Giuliani, Milltimber (GB)

(73) Assignee: Welldynamics, Inc., Spring, TX (US)

( * ) Notice: Subject to any disclaimer, the term of this patent is extended or adjusted under 35 U.S.C. 154(b) by 450 days.

(21) Appl. No.: 11/626,033

(22) Filed: Jan. 23, 2007

(65) Prior Publication Data

US 2008/0173454 A1 Jul. 24, 2008

(30) Foreign Application Priority Data

Jan. 24, 2006 (WO) ..... PCT/US2006/002304

(51) Int. Cl.
*E21B 33/00* (2006.01)
*E21B 33/10* (2006.01)

(52) U.S. Cl. ..... 166/324; 166/323; 166/375; 166/321

(58) Field of Classification Search ..... 166/324, 166/323, 375, 255.1, 313, 386, 319, 321
See application file for complete search history.

(56) References Cited

U.S. PATENT DOCUMENTS 4,467,833 A 8/1984 Satterwhite et al.
5,251,703 A 10/1993 Skinner
5,547,029 A 8/1996 Rubbo et al.
6,315,049 B1 11/2001 Hickey et al.
6,585,051 B2 7/2003 Purkis et al.
6,736,213 B2 5/2004 Bussear et al.
6,782,952 B2 8/2004 Garay et al.
6,796,213 B1 9/2004 McKendree et al.
7,145,471 B2 12/2006 Purkis et al.
2001/0037884 A1 11/2001 Schultz et al.
2002/0014338 A1 * 2/2002 Purkis et al. ..... 166/375
2003/0048197 A1 3/2003 Purkis et al.
2003/0131990 A1 * 7/2003 Tubel et al. ..... 166/250.01

OTHER PUBLICATIONS

International Search Report for PCT/US06/02304, dated May 7, 2007.

Written Opinion of the International Searching Authority for PCT/US06/02304, dated May 7, 2007.

International Search Report and Written Opinion issued May 26, 2009, for International Patent Application Serial No. PCT/US08/75668, 11 pages.

(Continued)

*Primary Examiner*—Kenneth Thompson
*Assistant Examiner*—Yong-Suk Ro
(74) *Attorney, Agent, or Firm*—Marlin R. Smith

(57) ABSTRACT

A method for positional control of an actuator includes applying pressure to both an input line and an output line connected to the actuator and then releasing a predetermined volume of fluid from the output line, thereby displacing a piston of the actuator a corresponding predetermined distance. A system for positional control of an actuator includes the actuator included in a well tool positioned in a well; the input line connected to the actuator and extending to a remote location; the output line connected to the actuator and extending to the remote location; and a fluid volume measurement device connected to the output line at the remote location. The fluid volume measurement device is operative to meter the predetermined volume of fluid from the output line.

27 Claims, 3 Drawing Sheets

OTHER PUBLICATIONS

Australian Office Action issued Feb. 4, 2010, for Australian Patent Application Serial No. 2006336428, 2 pages.

Canadian Office Action issued Nov. 18, 2009, for Canadian Patent Application Serial No. 2,637,326, 3 pages.

* cited by examiner

POSITIONAL CONTROL OF DOWNHOLE ACTUATORS

CROSS-REFERENCE TO RELATED APPLICATION

The present application claims the benefit under 35 USC §119 of the filing date of International Application No. PCT/US06/02304, filed Jan. 24, 2006, the entire disclosure of which is incorporated herein by this reference.

BACKGROUND

The present invention relates generally to equipment utilized and operations performed in conjunction with subterranean wells and, in an embodiment described herein, more particularly provides positional control for downhole actuators.

A pressure actuated downhole actuator is typically operated by applying pressure to a line in order to displace a piston of the actuator. However, some well tools, such as downhole chokes and other types of flow control devices, are operated using a type of actuator in which the piston is not just required to displace, but is also required to displace a certain distance or to a certain position in order to produce a desired change in the well tool. For example, a certain displacement of the piston may produce a corresponding change in flow rate through a downhole choke.

Unfortunately, pressure is generally applied to an input line of the actuator from a remote location, such as a surface location, which may be thousands of meters from the actuator. Fluid compressibility, friction, expansion of the input line due to applied pressure, thermal expansion of the input line and fluid, etc. cause it to be very difficult to determine how the piston displaces in response to pressure applied to the input line.

Various methods have been devised for overcoming this problem, but each of these methods has its own shortcomings. One method is to use a displacement sensor in the actuator to directly sense the movement of the piston. However, this method requires that the sensor be accommodated in the well tool, and that a communication system be provided for transmitting signals from the sensor to the surface. In addition, the sensor must be capable of withstanding the downhole environment (high temperatures/pressures, vibration, etc.).

Another method is to use a certain number or pattern of pressure applications to the input line to produce a corresponding displacement of the piston. However, this method requires that the well tool be designed with a control system capable of decoding the pressure applications, and that an operator at the surface be capable of determining when the appropriate pressure applications have been received and decoded at the control system. The more complex the control system, the less likely that it will survive long term in the downhole environment.

Therefore, it may be seen that improvements are needed in the art of positional control of downhole actuators. Preferably, systems and methods for controlling the position of a piston in a downhole actuator should be reliable and relatively inexpensive, but should provide for very accurate control of position.

SUMMARY

In carrying out the principles of the present invention, a system and associated method are provided which solve at least one problem in the art. One example is described below in which input and output lines of downhole actuators are pressurized simultaneously, and then fluid is released from an output line to displace a piston of a selected actuator. Another example is described below in which a volume of fluid released from the output line is measured using various techniques.

In one aspect of the invention, a method for positional control of at least one downhole actuator is provided. The method includes the steps of: applying pressure to both an input line and an output line connected to the actuator; and then releasing a predetermined volume of fluid from the output line, thereby displacing a piston of the downhole actuator a corresponding predetermined distance.

In another aspect of the invention, a method for positional control of a downhole actuator includes the steps of: applying pressure to an input line connected to the actuator; transmitting the pressure from the input line, through the actuator and to an output line connected to the actuator, the pressure being prevented from escaping from the output line by a valve; and then opening the valve, thereby releasing a predetermined volume of fluid from the output line, and displacing a piston of the actuator a corresponding predetermined distance.

In yet another aspect of the invention, a system for positional control of a downhole actuator is provided. The system includes the downhole actuator as part of a well tool positioned in a well. An input line is connected to the downhole actuator and extends to a remote location. An output line is connected to the downhole actuator and extends to the remote location. A fluid volume measurement device is connected to the output line at the remote location. The fluid volume measurement device is operative to meter a predetermined volume of fluid from the output line to thereby displace a piston of the downhole actuator a corresponding predetermined distance.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

Figure 1:
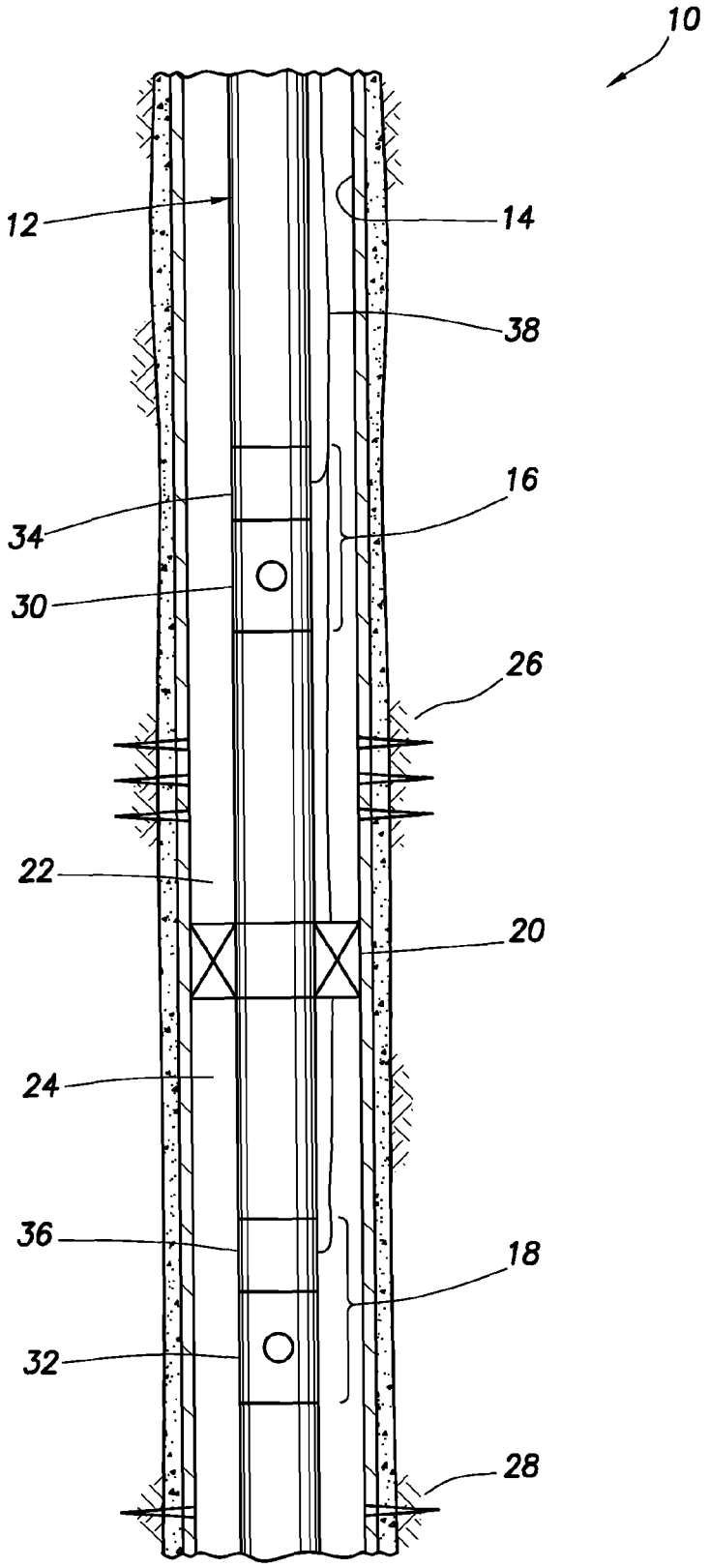
FIG. 1 is a schematic partially cross-sectional view of a system and associated method embodying principles of the present invention.

Representatively illustrated in FIG. 1 is a system 10 and associated method which embody principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, a tubular string 12 (such as a production tubing string) has been conveyed into a wellbore 14. The tubular string 12 includes two well tools 16, 18 and a packer 20 positioned between the well tools. The packer 20 isolates two annuli 22, 24 formed between the tubular string 12 and the wellbore 14.

The upper annulus 22 is in communication with an upper zone 26 intersected by the wellbore 14. The lower annulus 24 is in communication with a lower zone 28 intersected by the wellbore 14. The well tools 16, 18 each include a flow control device 30, 32 (such as a choke, valve, flow regulator, etc.) for controlling flow between the interior of the tubular string 12 and the respective annuli 22, 24.

To operate the flow control devices 30, 32, each of the well tools 16, 18 further includes a pressure operated actuator 34, 36. Lines 38 are connected to the actuators 34, 36 to conduct fluid and pressure between the actuators and a remote location, such as the earth's surface or another surface location (e.g., a subsea wellhead, floating or stationary rig, etc.), or a remote location in the wellbore 14.

It should be clearly understood that the principles of the invention are not limited to the details of the system 10 described herein. For example, the well tools 16, 18 could include devices other than flow control devices, it is not necessary for multiple well tools to be used, it is not necessary for the well tools to be interconnected in the tubular string 12, any number of well tools and/or actuators may be used, etc. The system 10 is described merely as one example of how the invention could be utilized.

Figure 2:
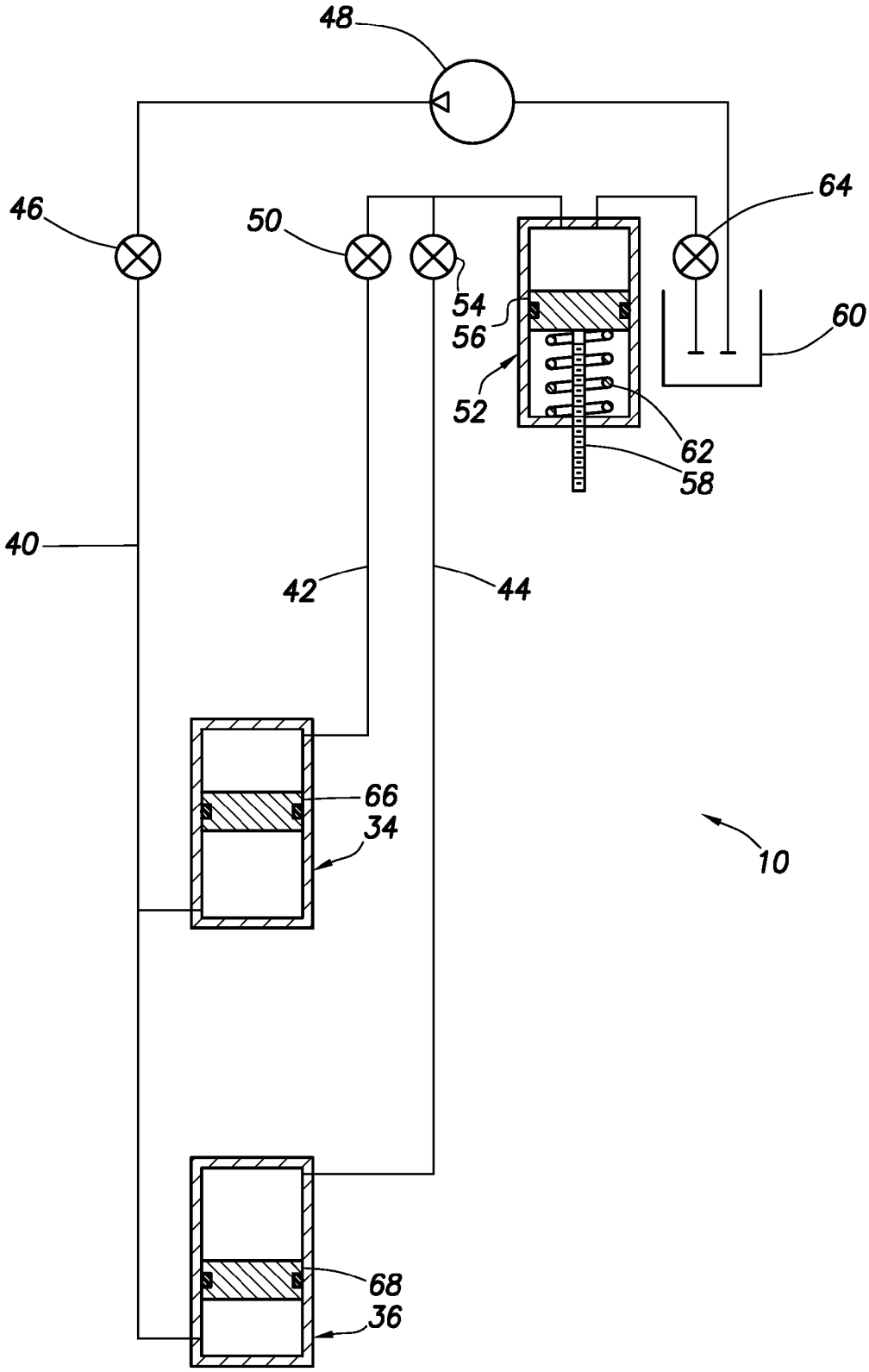
FIG. 2 is a schematic hydraulic circuit diagram for the system of FIG. 1.

Referring additionally now to FIG. 2, a schematic hydraulic circuit diagram of the system 10 is representatively illustrated. The actuators 34, 36 are depicted apart from the remainder of the well tools 16, 18 for simplicity and clarity of description.

Note that the lines 38 illustrated in FIG. 1 are represented in FIG. 2 by an input line 40 connected to each of the actuators 34, 36, and output lines 42, 44 connected to respective ones of the actuators. A separate input line could be connected to each of the actuators 34, 36 if desired, but only the single input line 40 is used in the representative system 10 for enhanced reliability and reduced expense. Similarly, a single output line could be connected to both of the actuators 34, 36 if desired, with a downhole manifold for selective communication between the actuators and the remote location via the output line.

A valve 46 is connected between the input line 40 and a pressure source 48 at the remote location. As depicted in FIG. 2, the pressure source 48 is a pump, but other pressure sources (such as an accumulator, compressed gas, etc.) could be used in keeping with the principles of the invention.

Another valve 50 is connected between the output line 42 and a fluid volume measurement device 52. The volume measurement device 52 is used to measure a volume of fluid discharged from the output line 42 (or the output line 44) as described in further detail below.

Yet another valve 54 is connected between the output line 44 and the volume measurement device 52. It will be appreciated that, by opening either the valve 50 or the valve 54, a respective one of the output lines 42, 44 may be placed in communication with the volume measurement device 52.

When one of the valves 50, 54 is opened, fluid flows from the respective output line 42, 44 into the volume measurement device 52, thereby displacing a piston 56. The displacement of the piston 56 can be directly measured (such as via a graduated indicator 58) to thereby directly measure the volume of fluid discharged from the output line 42 or 44.

After discharge of a predetermined volume of fluid from the output line 42 or 44, the respective valve 50, 54 is closed. The fluid in the volume measurement device 52 can then be discharged to a reservoir 60 via another valve 64, for example, using a biasing force exerted on the piston 56 by a spring 62.

Many different fluid volume measurement devices may be used in place of the device 52 depicted in FIG. 2. A few alternate volume measurement devices are representatively illustrated in FIGS. 3-6, but it should be clearly understood that any type of volume measurement device may be used in keeping with the principles of the invention.

Each of the actuators 34, 36 includes a respective piston 66, 68. Displacement of each of the pistons 66, 68 is used to operate the respective well tools 16, 18. For example, displacement of the piston 66 could be used to displace a closure member or choke member of the flow control device 30. Note that displacement of the pistons 66, 68 could be used to operate the respective well tools 16, 18, or to cause a change in operation of the respective well tools, in any manner in keeping with the principles of the invention.

In operation, pressure is applied to the input line 40 and both of the output lines 42, 44 by opening the valve 46 and applying pressure to the input line from the pressure source 48. The pressure is transmitted through the input line 40, and through the actuators 34, 36 to the output lines 42, 44. The valves 50, 54 are closed at this point to prevent the pressure from escaping from the output lines 42, 44.

When the applied pressure has stabilized in the input line 40 and output lines 42, 44, one of the valves 50, 54 is opened. A predetermined volume of fluid is thus permitted to flow from the respective output line 42 or 44 into the volume measurement device 52.

This discharge of a predetermined volume of fluid into the volume measurement device 52 causes a predetermined displacement of the respective piston 66 or 68. The displacement of the respective piston 66 or 68 causes a desired operation, or change in operation, of the respective well tool 16 or 18.

The valve 50 or 54 is then closed, and the valve 64 is opened to discharge the fluid from the volume measurement device 52 into the reservoir 60. The other one of the valves 50, 54 could then be opened to produce a desired displacement of the other one of the pistons 66, 68, or the same one of the valves could again be opened to produce another displacement of the same one of the pistons.

If no further displacement of either of the pistons 66, 68 is desired, then the valve 46 can be closed. The pressure applied to the input line 40 and the output lines 42, 44 can remain in these lines, or the pressure can be bled off. Bleeding off the pressure can produce some minimal displacement of the pistons 66, 68, but this can be predicted and accounted for when the respective pistons are displaced by opening the valves 50, 54 as described above.

It is an important feature of the system 10 that the pressure is applied to both the input line 40 and each of the output lines 42, 44 prior to opening one of the valves 50, 54. In this manner, the lines 40, 42, 44 are pressurized to a known reference pressure at which the lines have expanded to a certain extent, the fluid in the lines has been compressed to a certain extent, the lines and fluid are at an approximate equilibrium temperature in the well, etc.

To compensate for temperature in the well, expansion of the lines 40, 42, 44, compressibility of the fluid in the lines, etc., the reference pressure may be applied to the lines and allowed to stabilize. The valve 50 may then be opened and the piston 66 displaced its full stroke in the actuator 34.

The volume of fluid discharged into the volume measurement device 52 will then represent the full stroke of the piston 66. It will then be known what proportion of this fluid volume is required to produce a corresponding proportional displacement of the piston 66.

For example, to displace the piston 66 only half of its stroke in the actuator 34, fifty percent of the full stroke fluid volume should be discharged into the volume measurement device 52. The same procedure may be used to compensate for temperature, expansion, compressibility, etc. in operation of the other actuator 36.

It will be appreciated that the system 10 produces many benefits over prior methods of operating downhole actuators. One benefit is that complex calculations do not have to be used to compensate for temperature, expansion, compressibility, etc. in determining what volume of fluid should be pumped into an input line to produce a desired displacement of a piston in a downhole actuator. Another benefit is that the system 10 is relatively uncomplicated and does not rely on complex downhole mechanisms or sensors and their associated communication systems to determine displacement of a downhole piston. Yet another benefit is that these advantages are obtained economically, with only the lines 40, 42, 44 being installed downhole to operate the well tools 16, 18. Preferably, the valves 46, 50, 54, 64, pressure source 48 and volume measurement device 52 are installed at a surface location where they are conveniently operated and maintained.

Referring additionally now to FIGS. 3-6, alternate forms of fluid volume measurement devices are representatively illustrated for the system 10. Only a portion of the hydraulic circuit diagram of FIG. 2 is shown in each of FIGS. 3-6, but it will be appreciated that the remainder of the hydraulic circuit diagram is preferably the same as depicted in FIG. 2.

Figure 3:
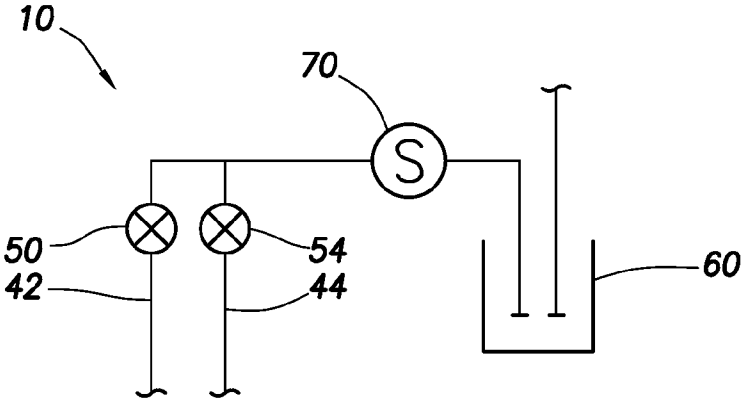
FIGS. 3-6 are alternate configurations of the hydraulic circuit of FIG. 2.

In FIG. 3 a fluid volume measurement device 70 includes a sensor interconnected between the valves 50, 54 and the reservoir 60. The sensor could be a volume meter which directly measures the volume of fluid flowing though the sensor. The sensor could instead be a flowmeter which measures a flow rate of fluid through the sensor. In that case, the fluid flow rate may be integrated over time to determine the volume of fluid which flows through the sensor. Other types of sensors may be used in keeping with the principles of the invention.

Figure 5:
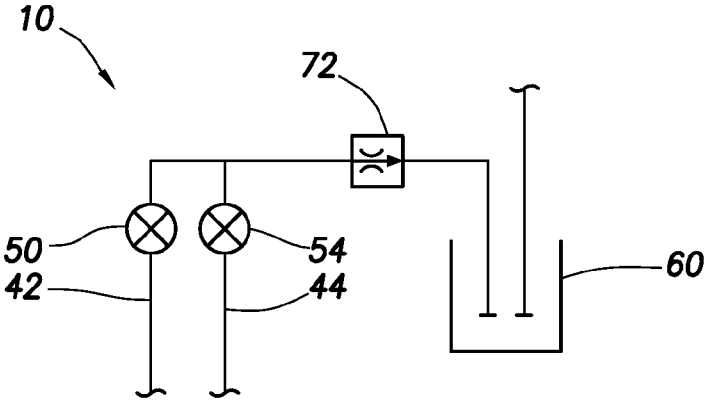

In FIG. 5 a fluid volume measurement device 72 includes a flow rate regulator which preferably maintains a relatively constant flow rate of fluid over a wide range of pressure differentials. If the flow rate is known (for example, using a flowmeter), then a duration of the flow can be determined which will produce a desired volume of fluid flow. Thus, the device 72 can include a timer for setting a duration of the flow through the device.

Figure 4:
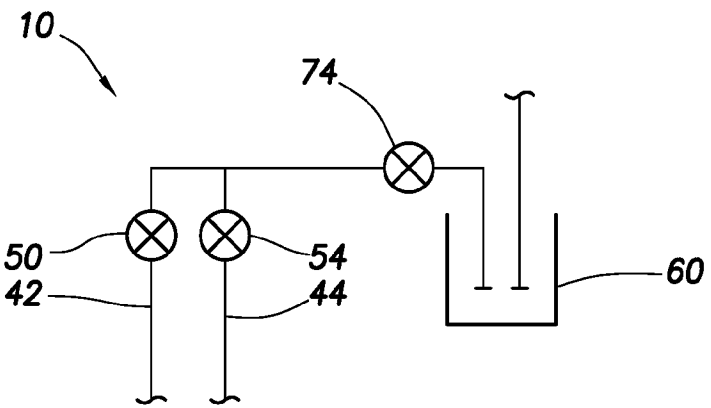

In FIG. 4 a fluid volume measurement device 74 includes a valve for controlling flow discharge into the reservoir 60. When calibrating the system 10 (compensating for temperature, expansion, compressibility, etc.) as described above, after the reference pressure has been applied to the lines 40, 42, 44 and a selected one of the valves 50, 54 has been opened, the valve of the device 74 may be opened and the time it takes to displace the respective one of the pistons 66, 68 its full stroke can be measured. Thereafter, when it is desired to displace the respective one of the pistons 66, 68 a certain proportion of its full stroke, the valve of the device 74 can be opened a corresponding proportion of the measured full stroke time. Thus, the device 74 can also include a timer for setting a duration of the flow through the device.

Figure 6:
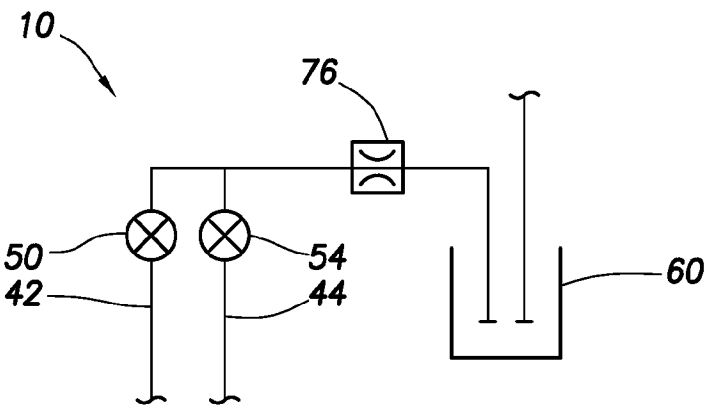

In FIG. 6 a fluid volume measurement device 76 includes a flow restrictor. The flow restrictor is preferably calibrated, so that for a certain fluid, temperature, pressure differential, etc., a flow rate of fluid through the restrictor is known. In this manner, a predetermined volume of fluid can be flowed through the restrictor, for example, by integrating the flow rate over time, or limiting a duration of a constant flow rate, etc. For these purposes, the device 76 may also include a timer for setting a duration of the flow through the device.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method for positional control of at least a first downhole actuator, the method comprising the steps of:

applying pressure to both an input line and a first output line, the input line being connected to an input of the first downhole actuator and the first output line being connected to an output of the first downhole actuator; and then releasing a first predetermined volume of fluid from the first output line into a fluid volume measurement device, thereby displacing a piston of the first downhole actuator a corresponding first predetermined distance.

2. The method of claim 1, wherein the pressure applying step further comprises applying pressure to input and output lines of multiple downhole actuators.

3. The method of claim 1, wherein the input line is connected to a second downhole actuator.

4. The method of claim 3, further comprising the step of releasing a second predetermined volume of fluid from a second output line connected to the second downhole actuator, thereby displacing a piston of the second downhole actuator a corresponding second predetermined distance.

5. The method of claim 4, wherein the pressure applying step further comprises applying pressure to the second output line.

6. The method of claim 1, wherein the first actuator is connected to a flow control device, and wherein the releasing step further comprises changing a rate of fluid flow through the flow control device.

7. The method of claim 1, wherein the releasing step further comprises directly measuring the first predetermined volume of fluid discharged from the first output line.

8. The method of claim 1, wherein the releasing step further comprises sensing a rate of fluid flow from the first output line.

9. The method of claim 1, wherein the releasing step further comprises regulating a rate of fluid flow from the first output line.

10. The method of claim 1, wherein the releasing step further comprises opening a valve for a predetermined period of time to permit the first predetermined volume of fluid to flow from the first output line.

11. A method for positional control of at least a first downhole actuator, the method comprising the steps of:

applying pressure to an input line connected to an input of the first downhole actuator;

transmitting the pressure from the input line, through the first downhole actuator and to a first output line connected to an output of the first downhole actuator, the pressure being prevented from escaping from the first output line by a first valve; and then opening the first valve, thereby releasing a first predetermined volume of fluid from the first output line into a fluid volume measurement device, and displacing a piston of the first downhole actuator a corresponding first predetermined distance.

12. The method of claim 11, wherein the opening step further comprises opening the first valve for a predetermined period of time to permit the first predetermined volume of fluid to flow from the first output line.

13. The method of claim 11, wherein the pressure applying step further comprises applying pressure to input and output lines of multiple downhole actuators.

14. The method of claim 11, wherein the input line is connected to a second downhole actuator.

15. The method of claim 14, further comprising the step of releasing a second predetermined volume of fluid from a second output line connected to the second downhole actuator, thereby displacing a piston of the second downhole actuator a corresponding second predetermined distance.

16. The method of claim 15, wherein the pressure applying step further comprises applying pressure to the second output line.

17. The method of claim 11, wherein the first actuator is connected to a flow control device, and wherein the valve opening step further comprises changing a rate of fluid flow through the flow control device.

18. The method of claim 11, wherein the valve opening step further comprises directly measuring the first predetermined volume of fluid discharged from the first output line.

19. The method of claim 11, wherein the valve opening step further comprises sensing a rate of fluid flow from the first output line.

20. The method of claim 11, wherein the valve opening step further comprises regulating a rate of fluid flow from the first output line.

21. A system for positional control of at least a first downhole actuator, the system comprising:

the first downhole actuator included in a well tool positioned in a well;

an input line connected to an input of the first downhole actuator and extending to a remote location;

a first output line connected to an output of the first downhole actuator and extending to the remote location; and a fluid volume measurement device connected to the first output line at the remote location, the fluid volume measurement device being operative to meter a first predetermined volume of fluid from the first output line to thereby displace a piston of the first downhole actuator a corresponding first predetermined distance.

22. The system of claim 21, wherein the fluid volume measurement device includes a timer for limiting a duration of fluid discharge from the first output line.

23. The system of claim 21, wherein the fluid volume measurement device includes a flow rate sensor.

24. The system of claim 21, wherein the fluid volume measurement device includes a flow rate regulator.

25. The system of claim 21, further comprising a second downhole actuator and a second output line connected to the second downhole actuator, and wherein the fluid volume measurement device is operative to meter a second predetermined volume of fluid from the second output line to thereby displace a piston of the second downhole actuator a corresponding second predetermined distance.

26. The system of claim 21, wherein the well tool includes a flow control device, and wherein displacement of the piston of the first downhole actuator changes a rate of flow through the flow control device.

27. The system of claim 21, wherein the fluid volume measurement device includes a sensor which directly measures the first predetermined volume of fluid.

* * * * *